United States Patent [19]

Riessland et al.

[11] 4,270,109

[45] May 26, 1981

[54] BOUNCE-FREE LIFTING DEVICE

[75] Inventors: Eberhard Riessland; Karl-Heinz Krüger, both of Dresden, German Democratic Rep.

[73] Assignee: VEB Elektromat, Dresden, German Democratic Rep.

[21] Appl. No.: 39,568

[22] Filed: May 15, 1979

[30] Foreign Application Priority Data

Jun. 1, 1978 [DD] German Democratic Rep. ... 205722

[51] Int. Cl.[3] ..... H01F 1/00; H01F 3/00; H01F 7/00

[52] U.S. Cl. ..... 335/277; 188/266; 269/310; 324/158 F; 335/257

[58] Field of Search ..... 335/277, 278, 257, 271, 335/281, 289, 291, 292; 324/158 F; 269/310, 312 WE; 251/48; 188/266

[56] References Cited

U.S. PATENT DOCUMENTS

| | | | |
|---|---|---|---|
| 3,936,743 | 2/1976 | Roch | 324/158 F |
| 3,972,505 | 8/1976 | Padula | 335/278 |

*Primary Examiner*—Harold Broome
*Attorney, Agent, or Firm*—Michael J. Striker

[57] ABSTRACT

The lifting movement of an armature of an electromagnet is braked by means of a gas which flows out under pressure between the abutment faces of a core of the electromagnet and the armature so that the gas is compressed therebetween and discharged in the outer atmosphere.

11 Claims, 4 Drawing Figures

BOUNCE-FREE LIFTING DEVICE

BACKGROUND OF THE INVENTION

The invention concerns a bounce-free lifting device, preferably for semi-conductor wafers in automatic wafer probes, which allows attaining a rapid lifting movement in sensitive systems.

GDR Letters Patent WP 101 783 describes a lifting device for rapid and bounce-free contacting, where the armature is held in two Belleville springs which, by having a steeper load-deflection line, will act with their spring effect against the force-travel line of the electromagnet. The spring constant is adjustable herein by variable initial tensioning. This lifting device is limited in its application to relatively small forces, i.e., with large semi-conductor wafers it is not possible to realize short operating times. The reasons herefor can be found in the large counteracting force of the progressively acting spring and the thus resulting high power requirement of the solenoid coil.

In the U.S. Pat. No. 3,936,743, a gripper head is described which realizes the lifting movement by means of an eccentric driven by a step motor. Herein, the friction between individual parts is of disadvantage as it also causes mechanical wear at these parts.

It is also of disadvantage that the gripping head consists of several individual parts and that exact parallel guiding of the holding surface in the operating position is difficult.

SUMMARY OF THE INVENTION

It is the objective of the invention to create, for larger wafer diameters, a bounce-free lifting device of simple mechanical design, not subject to any wear, and where the power losses of the actuating member can be lowered to such an extent that no additional measures for heat dissipation will be necessary.

The task of the invention consists in braking the movement of the armature prior to reaching the end positions through effective attenuation by means of a gas, preferably air, which flows out under pressure between the abutment faces of the core and the armature, so that the air between the abutment faces will be compressed and flow to the exterior through further attenuating devices.

The invention concerns a bounce-free lifting device wherein a gripper head mounted on a lifting armature will be moved in vertical direction between two end positions, by one or several electromagnets. Herein, the lifting armature is provided with a guide connected to the ferromagnetic core. Equally-spaced nozzles are arranged in the guide. One upper face of the ferromagnetic core is assigned a first abutting face of the lifting armature, and a lower face is assigned a second abutting face. Further nozzles are arranged equally spaced in one or several faces of the ferromagnetic core or of the lifting armature.

A gas, preferably air, flows under pressure from the nozzles. A first intermediate space is arranged between the upper face of the core and the first abutment face of the lifting armature, and a second intermediate space is arranged between the lower face and the second abutment face.

Narrow passages are provided as connection between the intermediate spaces and the exterior. The cross section of the narrow passages depends upon the position of the lifting armature. It is also possible to have the cross section of the narrow passages made variable by using throttling members. The narrow passages could possibly also be directly formed by the intermediate spaces.

On moving the lifting armature into one of the two end positions, the air in the appropriate intermediate space will be compressed and thus cause great deceleration. The narrow passages, the cross section of which is adjustable, serve for the suppression of the spring effect of the lifting armature upon the air cushion.

The abutment faces and/or the lower and upper faces, are in given instances split into magnetizable and non-magnetizable zones. The relation between forces of attraction and attenuation is adjusted thereby.

The lifting device contains one or two electromagnets. In the version with one electromagnet, a linear or non-linear return spring, acting opposed to the direction of the magnetic circuit of the relevant electromagnet, will, in a given case, be provided between the lifting armature and the core.

If each of the two end positions is assigned one electromagnet and thus a magnetic circuit, it is furthermore possible to couple both magnetic circuits via a common ground terminal. In such a case, the ground terminal will contain a permanent magnet which may also be assembled from segments. The permanent magnet prevents power loss on holding the lifting device, since only one electrical impulse is necessary to move the lifting armature.

BRIEF DESCRIPTION OF THE DRAWINGS

The invention is explained in more detail in connection with the accompanying drawings. Herein show.

DESCRIPTION OF THE PREFERRED EMBODIMENT

Figure 1:
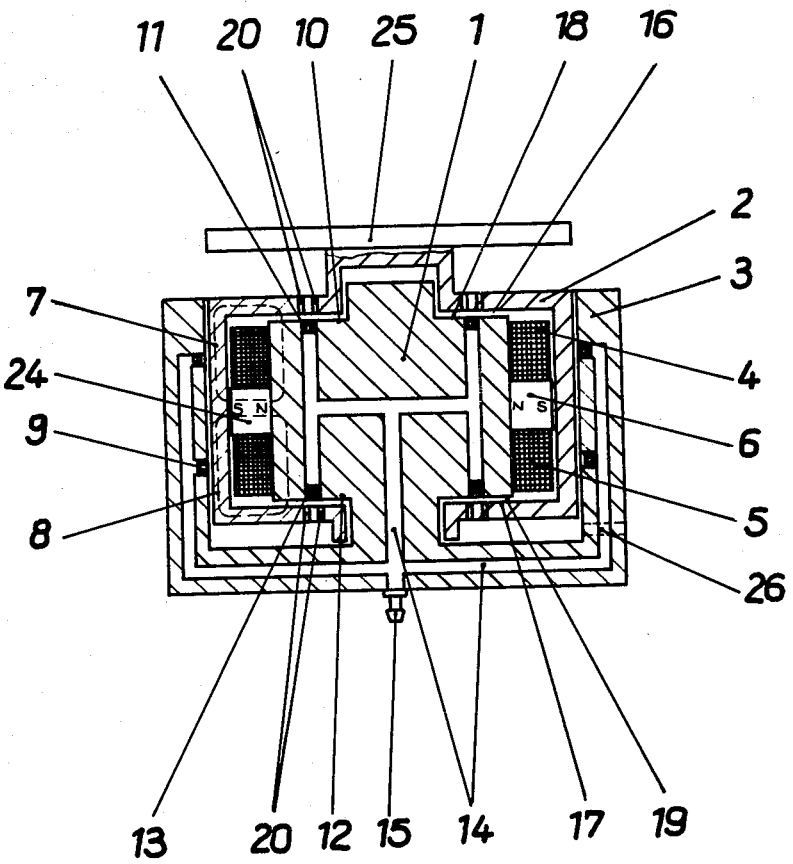
FIG. 1 A section through the bounce-free lifting device.

The bounce-free lifting device for semi-conductor wafers as per FIG. 1 is of symmetric design around its axis of rotation and consists of a ferromagnetic core 1. A lifting armature 2 surrounds the core 1. The lifting armature 2 on its part is encircled by the guide wall 3.

The core carries two electromagnets 4; 5, separated by the magnetic short-circuit member 6 which is connected with the core. The upper electromagnet 4 is assigned a magnetic circuit 7 and the lower electromagnet 5 is assigned a magnetic circuit 8. Within the guide wall 3, the nozzles 9 are equally distributed. The upper face 10 of the core 1 is assigned the first abutment face 16 of the lifting armature 2, and a lower face 12 is assigned a second abutment face 17. The nozzles 11 are equally distributed within the upper face 10 and the nozzles 13 are provided within the lower face 12. The nozzles 9; 11; 13 are connected via the passage system 14 with a connector 15.

Figure 2:
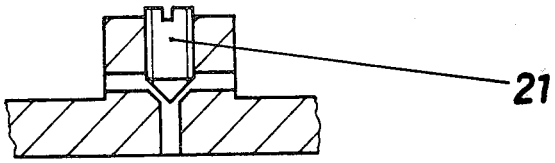
FIG. 2 Arrangement of the throttling members for adjusting the cross section of the narrow passages.

The face 10 and the abutment face 16 delimit an intermediate space 18 and the face 12 and the abutment face 17 an intermediate space 19. The intermediate space 18; 19 are, in given instances, connected with the exterior by narrow passages 20. Herein, the cross section of the narrow passages 20 may be determined by the position of the lifting anchor 2, or throttling members 21 may be provided as shown in FIG. 2.

Figure 3:
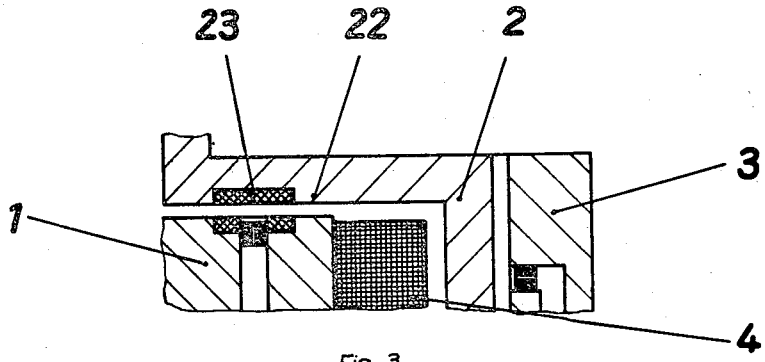
FIG. 3 Division of areas into magnetizable and non-magnetizable zones.

Furthermore it is possible as per FIG. 3 to divide the faces 10; 12 and/or the abutment faces 16; 17 into magnetizable zones 22 and non-magnetizable zones 23. Furthermore, the member 6 contains one permanent magnet 24 also assembled from segments to accommodate the work pieces. The lifting armature 2 carries a clamping table 25.

Exhaust passages 26 are arranged in the guide wall 3 to complete the connection of the intermediate space 19 and the narrow passages 20 to the exterior. Anti-rotating safeties are provided in the guide wall 3 to preclude inadvertent rotating of the lifting armature 2 relative to the guide wall 3 and thus to the core 1.

Figure 4:
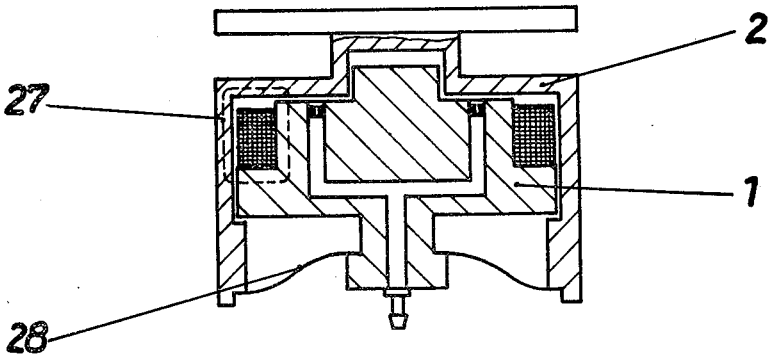
FIG. 4 Lifting device with one electromagnet.

A lifting device such as per FIG. 4 is also possible, with only one magnetic circuit 27 assigned to the core 1 and the lifting armature 2. Herein, a return spring 28 acting against the effective direction of the magnetic circuit may, if required, be attached between the core 1 and the lifting armature 2. The return spring 28 may have here linear or non-linear characteristics. On movement of the lifting armature 2, the air contained in the intermediate space 18 or 19 will be compressed and will slowly exhaust to the exterior. In order to adjust the desired values of attenuation, the cross section of the narrow passages 20 may, in given instances, be adjusted in the manner described. The division into magnetizable zones 22 and non-magnetizable 23 also serves for the setting of the desired ratio of force and for the attainment of an attenuated braking sequence.

What is claimed as new and desired to be protected by Letters Patent is set forth in the appended claims:

1. Bounce-free lifting device, comprising: at least one electromagnet having a stationary core defining a peripheral surface and two opposite end surfaces; a guide wall supporting said core and forming an interspace with said peripheral surface; a lifting armature disposed for reciprocating movement in said interspace, and enclosing said core, said armature defining two opposite abutment surfaces facing, respectively, said end surfaces and defining a gap therebetween; gas conduits provided in said core and in said guide wall; lateral nozzles arranged in said guide wall for connecting said conduits with said interspace and nozzles arranged in said end surfaces for connecting said conduits in said core with said gap.

2. The lifting device as defined in claim 1 wherein said nozzles are uniformly spaced one from each other.

3. The lifting device as defined in claim 1 further including passages in said abutment surfaces of said armature for connecting said gap with the outer atmosphere.

4. The lifting device as defined in claim 3 further including adjustable throttling members arranged in said passages.

5. The lifting device as defined in claim 1 wherein at least one magnetizing circuit is assigned to said core.

6. The lifting device as defined in claim 1 wherein at least one magnetizable circuit is assigned to said armature.

7. Bounce-free lifting device as defined in claim 1 wherein said end surfaces and said abutment surfaces are divided into magnetizable zones and non-magnetizable zones.

8. Bounce-free lifting device as defined in claim 6 further comprising a return spring acting against the effective direction of the magnetic circuit and being arranged between the lifting armature and the core.

9. Bounce-free lifting device as defined in claim 6 wherein two magnetic circuits are assigned to the lifting armature.

10. The lifting device as defined in claim 9 further comprising a magnetic short-circuit member coupling said magnetic circuits.

11. The lifting device as defined in claim 10 wherein said short-circuit member is a permanent magnet.

* * * * *